United States Patent [19]

Wech, Jr. et al.

[11] 4,431,362

[45] Feb. 14, 1984

[54] LOG LIFTER

[75] Inventors: Malcolm H. Wech, Jr., Box 429, Wyalusing, Pa. 18853; Lockwood L. Smiley, Wysox, Pa.

[73] Assignee: Malcolm H. Wech, Jr., Wyalusing, Pa.

[21] Appl. No.: 295,596

[22] Filed: Aug. 24, 1981

[51] Int. Cl.[3] ..... B27L 7/00

[52] U.S. Cl. ..... 414/685; 144/193 A; 414/745; 414/680

[58] Field of Search ..... 144/3 K, 193 A, 193 R; 414/680, 745, 748, 685, 501; 83/431

[56] References Cited

U.S. PATENT DOCUMENTS

| | | | |
|---|---|---|---|
| 1,843,852 | 2/1932 | Troy | 414/680 X |
| 3,242,955 | 3/1966 | Hellstrom | 144/193 A |
| 3,280,864 | 10/1966 | Spanenberg | 144/193 A |
| 3,667,620 | 6/1972 | Steiro | 414/680 |
| 3,812,951 | 5/1974 | Fullaway | 414/748 |
| 3,862,651 | 1/1975 | Heikkinen | 144/193 A X |
| 4,033,468 | 7/1977 | Brown | 414/680 |
| 4,286,638 | 9/1981 | Connolly et al. | 414/745 X |

*Primary Examiner*—Robert J. Spar
*Assistant Examiner*—Terrance L. Siemens
*Attorney, Agent, or Firm*—Charles S. McGuire

[57] ABSTRACT

Apparatus for lifting logs from ground level to a bed of a log splitting machine including at least two arms forming a loading rack for the logs and a pivotally mounted lifting arm assembly which is selectively engaged and operated by rearward motion of a slideably mounted sled which is a part of the log splitting machine. The loading rack may be actuated by lifting a catch pin into contact with a pin on the sled of the splitting machine or it may be disengaged at operator's selection.

4 Claims, 4 Drawing Figures

LOG LIFTER

BACKGROUND OF THE INVENTION

The present invention relates to timber handling apparatus and more particularly to apparatus for lifting pre-cut sections of timber on to a platform in preparation for a splitting operation.

DESCRIPTION OF PRIOR ART

U.S. Pat. No. 3,356,115 shows a device for splitting logs which includes a rack for holding a second log to be split above the splitting member which on rearward travel of a pusher plate positions the second log on the frame for splitting.

This patent has a major drawback in that it requires an operator or some external machine to lift the log on to the rack above the frame for splitting. It does not provide means for such lifting operation.

U.S. Pat. No. 3,862,651 shows apparatus for measuring, cutting and splitting timber which includes a hydraulically actuated loading rack which operates to lift a log to be measured and cut when hydraulic pressure is applied to a cylinder.

Although the patent shows an apparatus for lifting a log from ground level to the bed of a splitting device, the patent does not disclose any means for automatically controlling the application of pressure to a hydraulic cylinder in conjunction with other operations of the apparatus. The hydraulic cylinder requires an additional pressure source and is not part of the automatic functioning of the apparatus.

SUMMARY OF THE INVENTION

Therefore, it is an object of the present invention to lift logs from ground level to a bed of a log splitting apparatus by means of a loading rack which is operated during reverse motion of the log splitter sled.

It is another object of the present invention to lift logs from ground level to a bed of a log splitting apparatus by a loading rack as above which may be readily disengaged by operator action.

Accordingly, apparatus for lifting logs from ground level to a bed of a log splitting device includes a loading rack which is pivotally mounted to the bed of the log splitting apparatus, the loading rack having at least two arms to support a log to be lifted, the loading rack further including a bearing surface such as a bar against which a force is applied to lift said loading rack so that said log is loaded on to the bed of the log splitting apparatus, a lifting arm assembly mounted to the bed of the log splitting apparatus, the lifting arm assembly having a rotatable bearing surface which applies force to said bearing member on said loading rack and a sliding catch pin which is employed to engage the lifting arm assembly to be actuated on rearward motion of the log splitter sled.

It is an advantage of the present invention that logs to be split may be lifted from ground level to the bed of a log splitter by means of a loading rack which is selectively actuated during rearward travel of the log splitter sled using what would normally be wasted motion of the log splitting sled.

These and other objects of the present invention will become immediately apparent from the following detailed description in conjunction with the accompanying drawing.

DESCRIPTION OF A PREFERRED EMBODIMENT OF THE INVENTION

PRIOR ART

As indicated above in the background of the invention, U.S. Pat. No. 3,862,651 shows a log measuring, cutting and splitting machine which includes apparently almost as an after-thought an apparatus for lifting timber from ground level to the bed of a conveyer belt where the log is measured, sawed to length and then dropped to the bed of a splitting apparatus. The log lifting rack of the patent is actuated under manual control by application of pressure to a hydraulic ram which operates to lift the rack and thus the timber placed on the rack.

Figure 1:
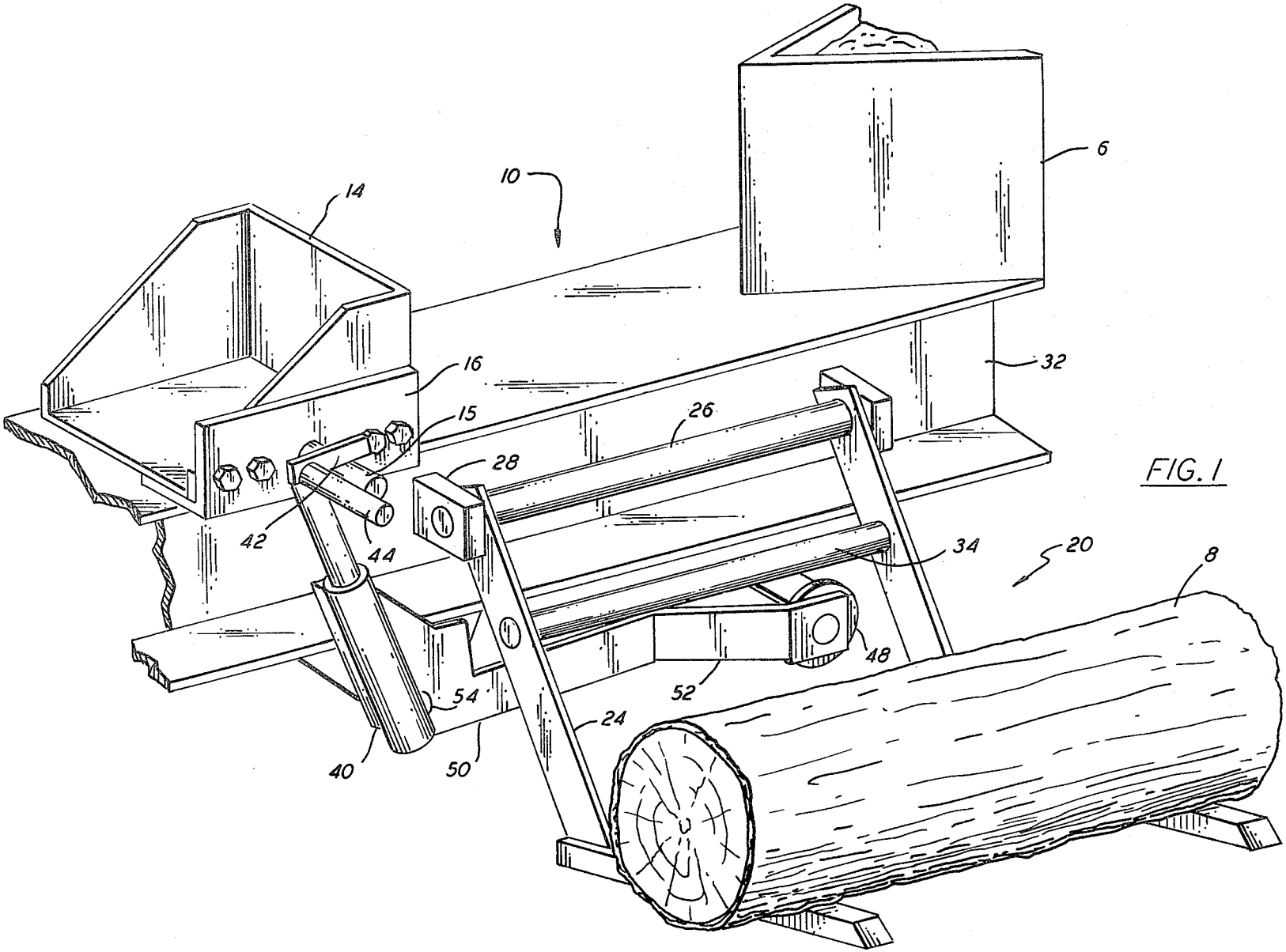
FIG. 1 is a perspective view of apparatus according to the present invention showing a log on a loading rack at the ground level position and showing the sliding catch pin of the lifting arm in the engaged position.
Figure 2:
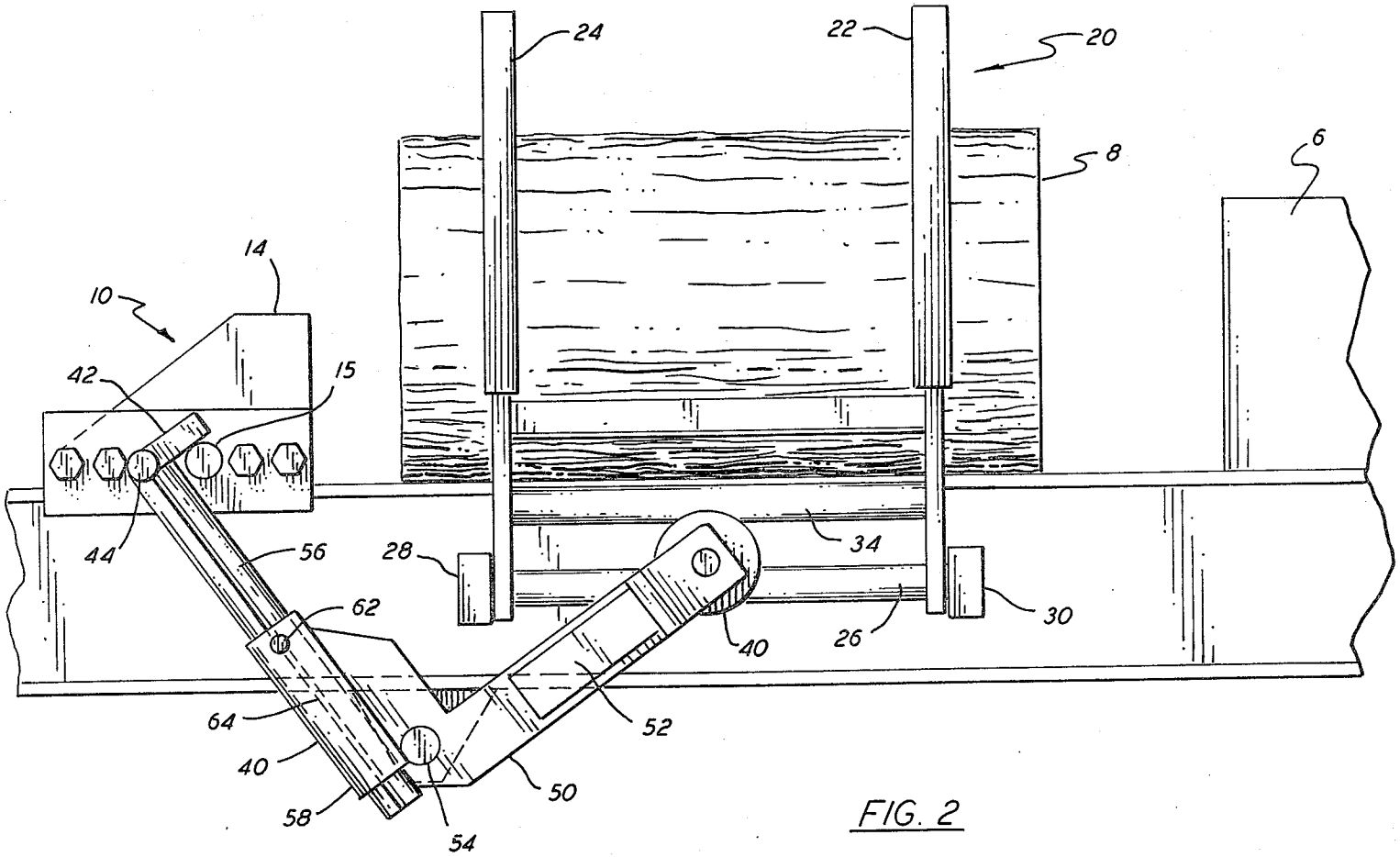
FIG. 2 is a side plan view of apparatus according to the present invention showing the loading rack in the fully raised position with the log lifted to the bed of the log splitting apparatus.

Referring now to FIGS. 1 and 2, the present invention will be described in detail.

A log splitting apparatus includes a log bed 12 which is shown in FIGS. 1 and 2 as an I beam, a hydraulically actuated sled 14 which is moved longitudinally along bed 12 by a hydraulic cylinder which is not shown. As sled 14 advances along bed 12, a log resting on bed 12 is forced against a splitting blade (not shown) and split into a number of smaller pieces. Log loading rack 20 includes arms 22 and 24 which are mounted on axle 26 which is rotatably mounted in bearing blocks 28 and 30 which are fixed to the web 32 of bed 12. Loading rack 20 also includes bearing bar 34 which is attached to arms 22 and 24 at a selected distance from axle 26 and which receives an upward force applied by lifing arm assembly 40 when sliding catch pin 42 is engaged to catch arm 15 mounted on a side member 16 of sled 14. Lifting arm assembly 40 includes a roller bearing 48 rotatably mounted in yoke assembly 52 at the end of lift arm 50.

It is noted that in FIG. 1 log 8 is shown at the ground level position while in FIG. 2 log 8 is shown resting on the bed 12 of splitting apparatus 10 having been lifted by operation of lifting arm assembly as sled 14 moves rearward.

Figure 3B:
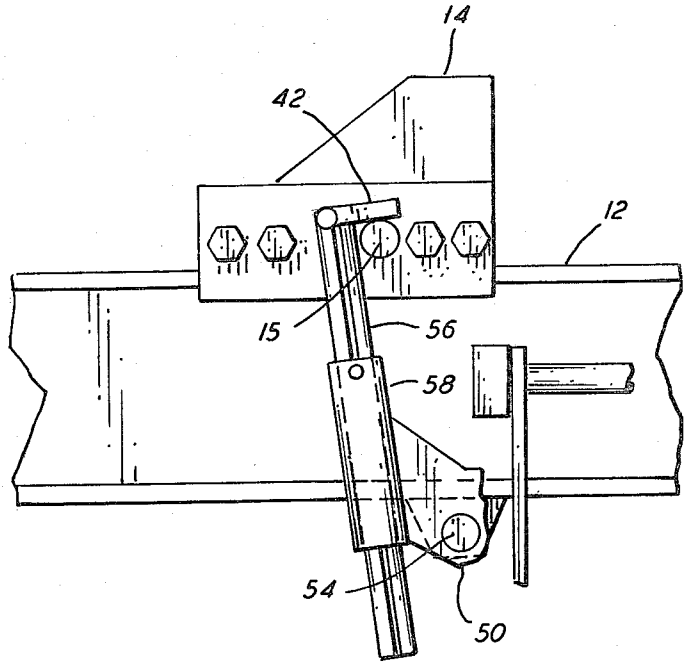
FIG. 3B is a side view of apparatus according to the present invention showing the slide catch pin in the engaged position.
Figure 3A:
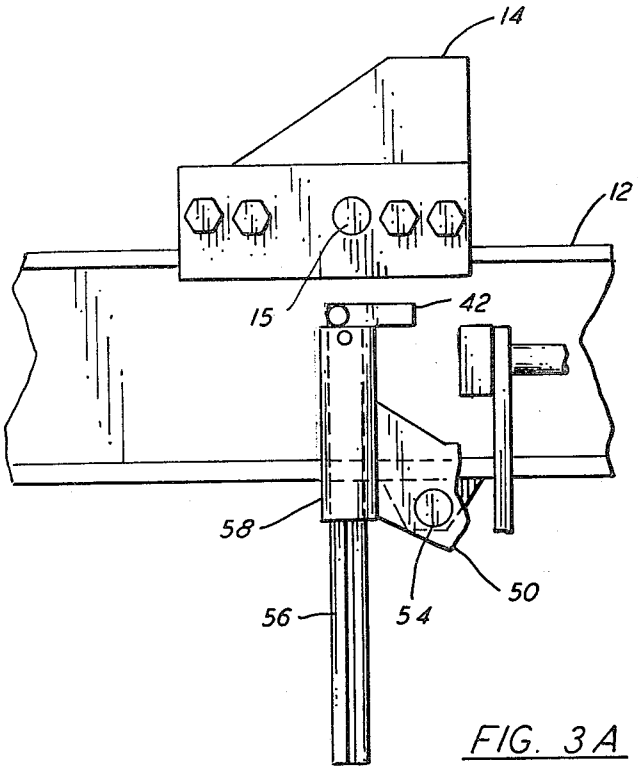
FIG 3A is a side view of apparatus according to the present invention showing the slide catch pin in the disengaged position.

Referring more specifically now to FIG. 2 and FIGS. 3A and 3B, the operation of lifting arm assembly 40 will be described in greater detail.

Lifting arm assembly 40 is pivotally mounted at pivot point 54 to a support member of the log splitting apparatus 10 not shown. A catch pin arm 56 is slideably mounted in sleeve 58 which is affixed to lift arm 50 by weld or other attachment means. Pin 62 is affixed to catch pin arm 56 and rides in slot 64 in sleeve 58 to prevent rotation of arm 56 during operation of the apparatus. Catch pin 42 and catch pin handle 44 are mounted at the upper end of catch pin arm 56.

FIG. 3A shows catch pin arm 56 retracted into sleeve 58 and not engaged on pin 15. In this position, the loading rack 20 would remain in the lowered position and would not be activated on the rearward travel of sled 14.

FIG. 3B shows catch pin arm 56 extended with catch pin 42 engaged with pin 15 on sled 14 such that as sled 14 travels rearwardly along bed 12 lifting arm assembly 40 rotates about point 54 and lift arm 50 causes roller bearing 40 to bear against bearing arm 34 on loading rack 20 causing loading rack 20 to be lifted carrying log 8 from ground level to bed 12 of the log splitting apparatus.

As sled 14 moves forward, in the direction of the splitting edge, catch pin 42 disengages from pin 15 and loading rack 20 is lowered to ground level position.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. Apparatus for attachment to and operation with a power-operated log splitter having a bed for longitudinal placement of a log between a splitting wedge and a sled reciprocally movable along said bed by a hydraulic cylinder in forward and return strokes, said apparatus comprising:

(a) a loading rack pivotally connected to one side of said log splitter for rotation about an axis adjacent said bed and parallel to the direction of movement of said sled between a first position, wherein a portion of said rack is substantially at ground level to receive a log, and a second position, wherein said portion is elevated above said bed to deposit the log thereon;

(b) a pin fixedly connected to said sled and extending outwardly therefrom on said one side of said log splitter; and (c) motion transmission means having a first part selectively engageable with said pin and movable with said sled when so engaged, and a second part contacting said loading rack to effect rotation thereof from said first position to said second position in response to movement of said sled upon said return stroke.

2. The invention according to claim 1 wherein said motion transmission means is pivotally connected to said log splitter at a point between said first and second parts, for reciprocal rotation about an axis perpendicular to the direction of movement of said sled.

3. The invention according to claim 2 wherein said first part of said motion transmission means comprises elements slideably movable with respect to one another as said means is rotated and to provide said selective engagement and disengagement with said pin.

4. The invention according to claim 3 wherein said second part of said motion transmission means comprises a roller member which travels along an engagement portion of said loading rack during rotational movement of said motion transmission means and said loading rack.

* * * * *